US009038644B2

(12) United States Patent
Brown et al.

(10) Patent No.: US 9,038,644 B2
(45) Date of Patent: May 26, 2015

(54) METHOD OF APPLYING PHASE TRANSITION MATERIALS TO SEMI-POROUS, FLEXIBLE SUBSTRATES USED TO CONTROL GAS PERMEABILITY

(75) Inventors: Steven E. Brown, Oak Ridge, NC (US); Alexander J. Dyakonov, Greensboro, NC (US); Luis A. Sanchez, Greensboro, NC (US)

(73) Assignee: Lorillard Tobacco Company, Greensboro, NC (US)

( * ) Notice: Subject to any disclaimer, the term of this patent is extended or adjusted under 35 U.S.C. 154(b) by 7 days.

(21) Appl. No.: 13/412,357

(22) Filed: Mar. 5, 2012

(65) Prior Publication Data

US 2012/0305013 A1 Dec. 6, 2012

Related U.S. Application Data

(60) Provisional application No. 61/449,299, filed on Mar. 4, 2011, provisional application No. 61/449,280, filed on Mar. 4, 2011, provisional application No. 61/450,375, filed on Mar. 8, 2011.

(51) Int. Cl.
*A24D 1/02* (2006.01)

(52) U.S. Cl.
CPC ..... *A24D 1/025* (2013.01)

(58) Field of Classification Search
USPC ..... 131/284, 365
See application file for complete search history.

(56) References Cited

U.S. PATENT DOCUMENTS

| | | | | |
|---|---|---|---|---|
| 5,878,753 | A * | 3/1999 | Peterson et al. | 131/365 |
| 2004/0234794 | A1 * | 11/2004 | Schadenberg et al. | 428/467 |
| 2008/0060741 | A1 * | 3/2008 | Privitera et al. | 156/73.1 |
| 2011/0030709 | A1 * | 2/2011 | Sebastian et al. | 131/365 |

FOREIGN PATENT DOCUMENTS

WO WO 02/43513 * 6/2002

* cited by examiner

*Primary Examiner* — Richard Crispino
*Assistant Examiner* — Eric Yaary
(74) *Attorney, Agent, or Firm* — Dykema Gossett PLLC

(57) ABSTRACT

Method of applying phase transition substance to impart reduced ignition propensity to a smoking article comprising a tobacco column and a wrapper surrounding the tobacco column and having a porous structure with a base permeability. The method comprising forming a pattern of phase transition material on the wrapper such that, when subjected to the heat of the tobacco column burning firecone, the phase transition material at least partially fills the wrapper porous structure in the vicinity of the burning firecone to form an area on the wrapper having reduced permeability lower than that of the wrapper base permeability. The reduced permeability of the wrapper in the vicinity of the burning firecone imparts reduced ignition propensity such that there is insufficient air flow to sustain combustion of the firecone or insufficient air flow to sustain an intensity of the burning firecone necessary to ignite the substrate.

20 Claims, 21 Drawing Sheets

Prior art cigarette wrapper with fixed banded regions (FB) of reduced permeability Cigarette wrapper treated with patterned application of PTM Air permeability of a highly porous heat-treated PTM-modified papers

A

B

C

A

19 CU control

B

PTM – no heat

C

PTM – heated

PTM - spread

As deposited

Hot pressed

Morphology of PTM on cigarette paper
500 X magnification

"Heat and press" morphology and ignition propensity impact

Effect of "Heat and press" on LIP index %

METHOD OF APPLYING PHASE TRANSITION MATERIALS TO SEMI-POROUS, FLEXIBLE SUBSTRATES USED TO CONTROL GAS PERMEABILITY

This application claims priority to U.S. application No. 61/449,280 file Mar. 4, 2011, U.S. application No. 61/449,299 file Mar. 4, 2011 and U.S. application No. 61/450,375 filed Mar. 8, 2011, the entire contents of which are incorporated herein by reference.

FIELD OF THE INVENTION

The present invention relates generally to methods of applying phase transition materials to a wrapper for a smoking article to create a reduced ignition propensity smoking article and, more particularly, to a smoking article having the ability to free burn in a static state and reduced ignition propensity.

BACKGROUND

Under some circumstances smoking articles (e.g., cigarettes) may ignite fire-prone substrates if the article is laid on or accidentally contacts such substrate. Therefore, a cigarette prepared from a wrapper which diminishes the ability of the article to ignite a substrate may have the desirable effect of reducing cigarette-initiated fires. Furthermore, a wrapper that concurrently confers on the cigarette the ability to free burn in a static state and reduced IP character allows a beneficial reduction in the tendency of the article to ignite fire-prone substrates while maintaining consumer acceptability. Other factors affecting consumer acceptability include product appearance as well as pleasing and consistent wrapper and ash character. Moreover, it is important that the construction of the smoking article exhibits a reasonable shelf-life while maintaining reduced IP.

It has been determined that cigarette wrapper porosity characteristics may contribute to both the reduced IP and free burn properties for a cigarette. Porous substrates and membranes have utility in a wide variety of applications, most of which involve selective flow of a fluid, gas or particulates through the pores. For example, separations of particulate matters from gases or liquids are common commercial applications of microporous membranes. Furthermore, enhanced separation of homo-, heterogeneous mixtures can be achieved by modification of the physico-chemical characteristics of membranes. Such application of enhanced separations are found in electrochemical cells (e.g. batteries, fuel cells, sensors, and capacitors) wherein membranes are used to separate electrodes while simultaneously allowing ions to transport. In these cases, the physical dimensions of pores and the surface chemistry are tailored to optimize performance. To that end, a cigarette paper can be thought of as a flexible membrane that surrounds a tobacco column, allowing gas diffusion in and out of the column during burning while holding/retaining the finely divided tobacco in a rod form.

Many methods exist to fabricate membranes of well-defined pore structure of membranes. Those known in the arts include (i) laser drilling of holes that yields perforated, straight-thru, and/or non-torturous holes in the filter membranes; (ii) evaporation of dissolved gases in a melted or reactive polymer, followed by chemical, mechanical or thermal breakage of cell walls to produce open cell foams; (iii) addition and activation of chemical blowing agents followed by chemical, mechanical or thermal breakage of cell walls to produce open cell foams; (iv) addition of soluble particles at high concentration in the polymer, followed by dissolution of the soluble particles to produce filter membranes with pores that match their original particle sizes and locations; (v) addition of plasticizer to a high concentrated polymer, followed by extraction of this plasticizer by a low-boiling solvent to produce an open cell battery separator; (vi) compression of polymer particles within a liquid medium causing bonds to form between such particles, followed by stretching of the polymer film either uniaxially or biaxially to produce gas/liquid separation membranes; (vii) slitting of a polymer film followed by lateral stretching; (viii) sol-gel, internal phase inversion followed by evaporation of solvent and production of an open-cell membrane; (ix) formation of patterned and collapsible porous structures yielding semi-porous membranes; (x) a sol-gel type, external phase inversion, followed by addition of an external to the polymer solution producing an open cell filter membrane. In similar methodology, cigarette papers can be manufactured to specific porosity using well-known paper making processes that result in specialty papers of a wide range of porosities for specific product requirements.

Chemical modification of the porous membranes to enhance specific separation properties is also known in the art, which teaches different approaches to modify semi-porous membranes during or after fabrication. The corresponding chemical processes include but are not limited to (1) modification of the surface of semi-porous membrane to make it either hydrophobic, or hydrophilic, or possessing the preferential affinity to specific chemical functional groups, therefore enabling selective retention; (2) UV radiation; (3) plasma radiation; (4) microwave radiation treatment.

The prior art teaches methods of fabrication or post-treatment modification of a semi-porous membrane to alter its porosity for controlling and reducing its gas permeability during use. For example, it is known to modify porous paper used in cigarette products by applying a starched based coating/layer by gravure techniques. The purpose of the coating is to create bands or regions that reduce the gas permeability of the paper substrate. Subsequently, the reduced oxygen flow in the coated regions imparts an ignition propensity to the article. In this case the pore structure of the membrane (paper) is reduced from the original base paper and remains static during use. Besides adding paper conversion costs to cigarette fabrication, this method is normally limited to off-line implementation because it requires drying the paper prior to use in cigarette making in addition to negatively affects the user experience if higher ignition propensity is desired.

SUMMARY OF THE INVENTION

The present invention is directed to the methods of altering or modifying the physical and/or chemical nature of the semi-porous membranes when exposed to an environmental stimulus such as temperature or pressure upon use. In this case, for example, the gas permeability of the membrane can be altered dynamically during usage to reduce the quantity of gas passing through the membrane.

According to one embodiment of the present invention, phase transition materials, such as waxes, are applied to a cigarette wrapper to provide a desirable reduced Ignition Propensity (IP) effect while maintaining free burn performance. Applicants have found that the method by which the PTM (phase transition material) is applied greatly affects the overall efficacy and performance of this new reduced IP technology. In this case, the efficiency is measured by the overall quantity of the PTM needed to reduce the permeability to achieve the reduced IP effect, the rate at which the effect takes place, and the reproducibility (robustness) of the self extinguishing property of the smoking article without effecting the narcoleptic properties and the expected user experience.

Further aspects of the present invention include (1) the manners of application of the PTM to achieve an optimal reduced IP performance, (2) the relationships between the quantities of applied PTM, the applied patterns and the paper characteristics, and (3) the relevance of the chemical compositions of the PTM material and their special relevance to reduced IP performance.

BRIEF DESCRIPTION OF THE DRAWINGS

The invention will be better understood after reading of the following description of the preferred embodiments when considered with the drawings in which.

DESCRIPTION OF THE PREFERRED EMBODIMENTS

Figure 1:
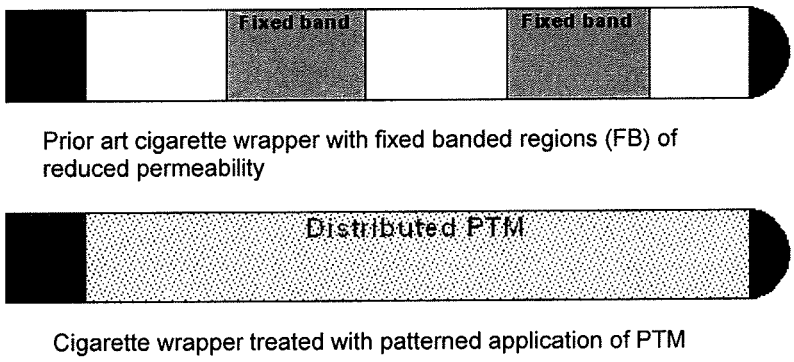
FIG. 1 is a schematic illustrating configurations of the prior art commercial fixed starch-band reduced IP cigarette and a cigarette embodying the present invention having a wrapper with a patterned or uniform, non-continuous layer of PTM.

Referring now to the drawings in general, it will be understood that the illustrations are for the purpose of describing preferred embodiments of the invention and are not intended to limit the invention thereto.

The present invention is directed to novel methods of deposition of discrete patterns of phase transition materials (PTM) such as paraffin, carnauba, tobacco wax, Solanosol, beeswax, and microcrystalline wax, menthol and other fragrances or materials capable of having a phase transition in the operating range on a semi-porous and flexible substrate to allow the regulation and control of gas permeability through the semi-porous membranes without significantly perturbing their initial gas permeability.

The PTM powders, solutions or dispersions can be deposited on semi-porous membrane using a wide variety of well-known depositions and printing technologies to achieve a uniform, non-continuous coating. For example, spraying at normal and elevated temperatures, electrostatic spraying, inkjet printing, gravure, screen printing, electrophotography and flexography are some of the application techniques that provide a high degree precision and control the placement of PTM particles. As disclosed herein, those techniques have been adapted to apply phase transition materials, suitable to achieve an ignition propensity effect, as previously described, to the cigarette paper. The application techniques are capable of producing patterns that can be random, systematic, combination of thereof, or can form the patterns with respect to the pore distribution of semi-porous membranes. Likewise, the patterns could consist of individual drops, spots, spheres (of various diameter and surface areas), clusters (regular and irregular), PTM bands, zones and other 2- and 3-dimensional structures, or ensembles and combinations of the above. The PTM formulations themselves could be deposited as a single or multiple PTM formulations deposited in subsequent steps of application. In addition, the PTM can also be deposited in conjunction with previously starch treated or otherwise modified semi-porous membrane.

Furthermore, the surface-distributed PTM particles of any predetermined shape and size can consist of homogeneous and/or heterogeneous compositions or combination thereof. Homogeneous composition is defined as a chemical formulation that shows no macroscopic variation in selected properties throughout the material. In contrast, a heterogeneous composition shows such variations in either the original form as observed in a multiphase system or variations induced by physical stresses such as heat, sheer forces, etc. The present invention also encompasses the deposition of a homogeneous PTM formulation on top of a heterogeneous formulation, or the other way around, or in the form of an individual or a plurality of layers for the modification of characteristics of semi-porous membranes.

Phase transitions materials (PTM) are understood as materials that undergo phase changes with changes of intensive variables, i.e., temperature, pressure, sunlight or other irradiation, or exposure to a certain chemical compound. Phase transitions include melting, vaporizing, subliming, forming of eutectic, peritectic, spinodal solid phases and other physical transformations.

The disclosed methods of PTM deposition on semi-porous substrates or membranes to control their gas permeability may be used alone or in combination with each other, or in combination with other known deposition methods. Various methods can be implemented for deposition of PTM material during a single or multiple step deposition operation. Both the methods of PTM deposition, and the types of PTM formulations result in specific changes in the structure of porous membranes and have relevance to achieving the reduce ignition propensity (IP) of the composed smoking articles at minimal PTM content.

According to the present invention, reduced IP effect can be achieved by forming a non-continuous, uniform layer of the PTM on the cigarette paper. When the cigarette is ignited, the PTM in the vicinity of the burning firecone melts and creates a low gas permeable circumferential band that limits the oxygen supplied to the firecone. More specifically, when subjected to the temperature generated by the burning firecone, the PTM transitions from solid to a liquid state and wicks primarily radially into the wrapper. As the PTM wicks, it forms a non-porous band, which reduces the air supply to firecone. The formation of the reduced gas permeability or reduced porosity circumferential band is referred to herein as the "Transient Band" as it is only formed during smoking ahead of the firecone. This band is dynamic and not fixed, such that it continuously moves ahead the firecone. The rate and extension of the wicking process is governed by the nature of the paper and PTMs and their interactions. Proper selection of the PTMs and application method dramatically impact the speed at which the Transient Band is formed and subsequently the speed at which the smoking article will extinguish. The oxygen supply is sufficient to maintain smoldering in the firecone when the cigarette is freely suspended. However, if the cigarette is contacted with a substrate, the oxygen supply is further reduced to a level insufficient to sustain smoldering in the firecone and the cigarette self-extinguishes. FIG. 1 illustrates the topographical differences between the prior art fixed-band reduced IP technology and the present invention. As shown in FIG. 1, the reduced IP technology for the present invention may occur along the full cigarette column versus discrete reduced IP in the fixed-band technology.

Figure 2:
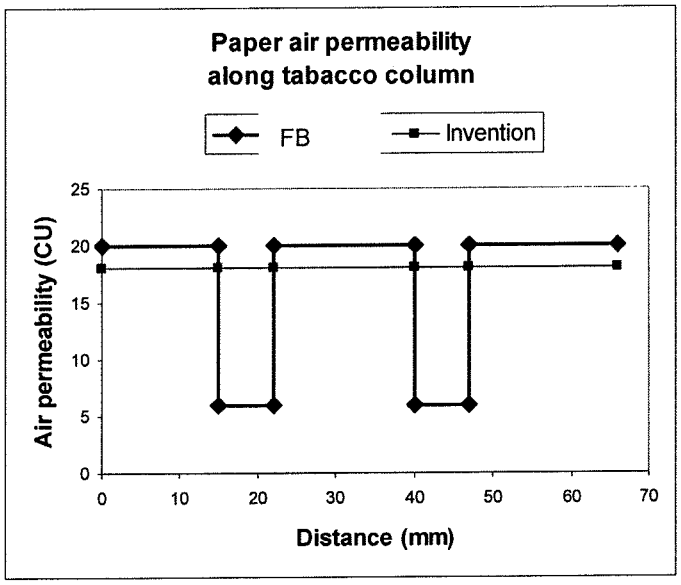
FIG. 2 is a chart showing the air permeability through the cigarette paper of the prior art fixed band reduced IP cigarette and the new reduced IP cigarette with PTM formulation to form a transient circumferential band of reduced permeability upon smoldering.

According to the present invention, the initial air permeability of the paper, as measured in Coresta units, is not significantly reduced as a result of a uniform, non-continuous PTM layer on the surface of the paper yet it dramatically reduces when exposed to a sufficiently high temperature. This is demonstrated in FIG. 2 which shows that smoking articles embodying the present invention have constant air permeability along the column length, whereas the air permeability of the prior art fixed-band starch-band reduced IP smoking articles drops by more than 70% at the starch-bands. This starch-band construction feature affects both reduced IP effectiveness and the smoke taste, associated with the tobacco combustion/pyrolysis analytes. Therein this invention is capable of a more efficient reduced IP performance without degrading smoking article narcoleptic properties.

The overall reduced IP efficacy of the present invention is a result of the deposition method, distribution and nature of PTM on the paper, and quantity of PTM deposited on the paper. The means by which a PTM is applied impacts the performance and efficiency of the reduction of gas permeability with respect to untreated paper. In this case, the efficiency is measured by the overall quantity of PTM needed to reduce the air permeability to achieve reduced ignition propensity effect, the rate at which this takes place, and the reproducibility (robustness) of the self-extinguishing property of smoking article. In addition, the free burn characteristics of smoking article and a consistent balance of smoke analytes during cigarette combustion are improved using this invention over the existing starch-band technology.

Figure 3:
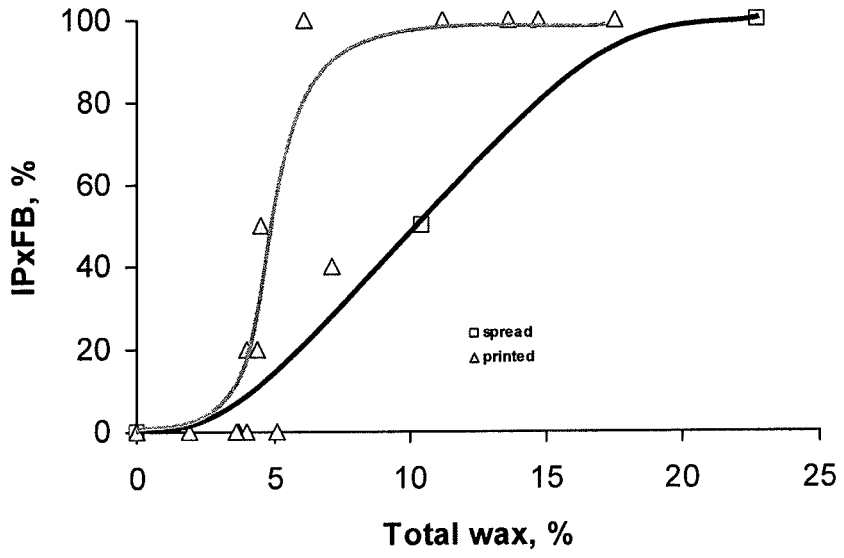
FIG. 3 is a graph of the LIP performance (understood as the product IP and FB) of cigarettes embodying the present invention made of printed and hot-melt sprayed PTM formulation.

To this end, applicants have developed a LIP performance index which quantifies both the free burn and reduced IP properties for cigarettes. The LIP performance index (IP×FB) is the product of the measured probability of a smoking article's reduced ignition propensity (IP) success rate and free burn (FB) success rate. It will be understood that the LIP index is calculated based on the FB and reduced IP performance characteristics of a sample population of at least 10 cigarettes, and preferably a sample population of 20 or 40 cigarettes. When the LIP performance index is 100%, all samples of the tested population of smoking articles have satisfactorily passed both the reduced IP and free burn tests. A low LIP performance index indicates that some of the cigarettes in the sample population did pass the reduced IP and/or FB tests. In connection with the present invention, the LIP performance index can be a function of the deposition methods of the PTM, the concentration of PTM on paper, the melting properties of the PTM, and the dispersion properties of the PTM in aqueous and non aqueous media, as well as the distribution pattern of PTMs on the cigarette paper. FIG. 3 shows an excellent LIP performance for two different deposition methods using two different PTM compositions illustrating the LIP index performance on both PTM composition and deposition method. Application of the PTM using a wax jet type printing deposition method yields a 100% LIP performance index with about 3-5% PTM on the 19 C.U. paper wrapper. Application of an alternate PTM formulation using a hot-melt spray method yields a 100% LIP performance index with about 20% PTM on 19 C.U. paper wrapper.

Applicants have found that a LIP index of 90% and greater is achieved when at least 60-65% of the pores of the wrapper paper are filled when the PTM melts. Applicants have also found that the formulation and method of application can minimize the amount of PTM necessary to achieve the desired level of LIP index, and organoleptic properties of the smoking article, including desirable combustion properties.

Figure 4:
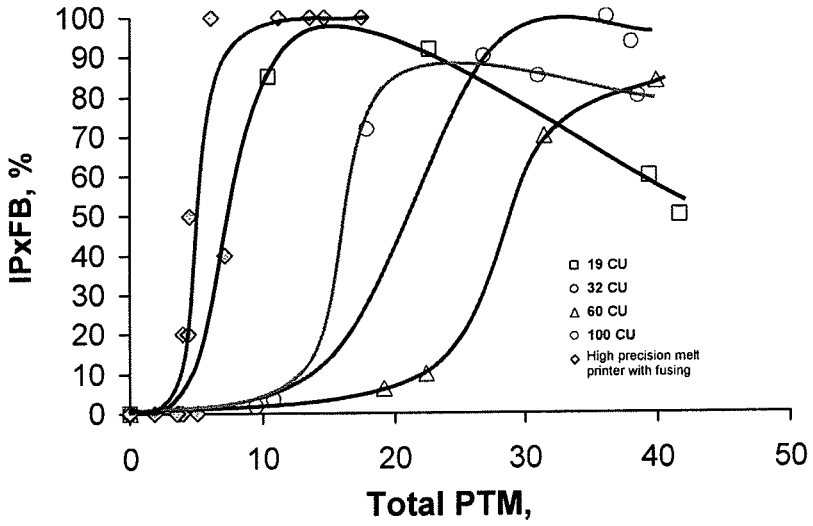
FIG. 4 is a graph of the LIP performance of cigarettes embodying the present invention made of printed and hot-melt sprayed PTM formulation on different papers with air permeabilities from 19 to 100 C.U.

Applicants have found that the benefits of the present invention also apply to cigarettes regardless of the wrapper base or initial air permeability. For example, as shown in FIG. 4, favorable LIP performance indices were achieved with cigarettes embodying the present invention having wrapper base permeability of 19, 32, 60 and 100 C.U. Applicants have found that the improved LIP performance index for each of these test subjects depends on the amount of PTM deposited on the paper surface and on the PTM formulation chemistry.

Figure 5:
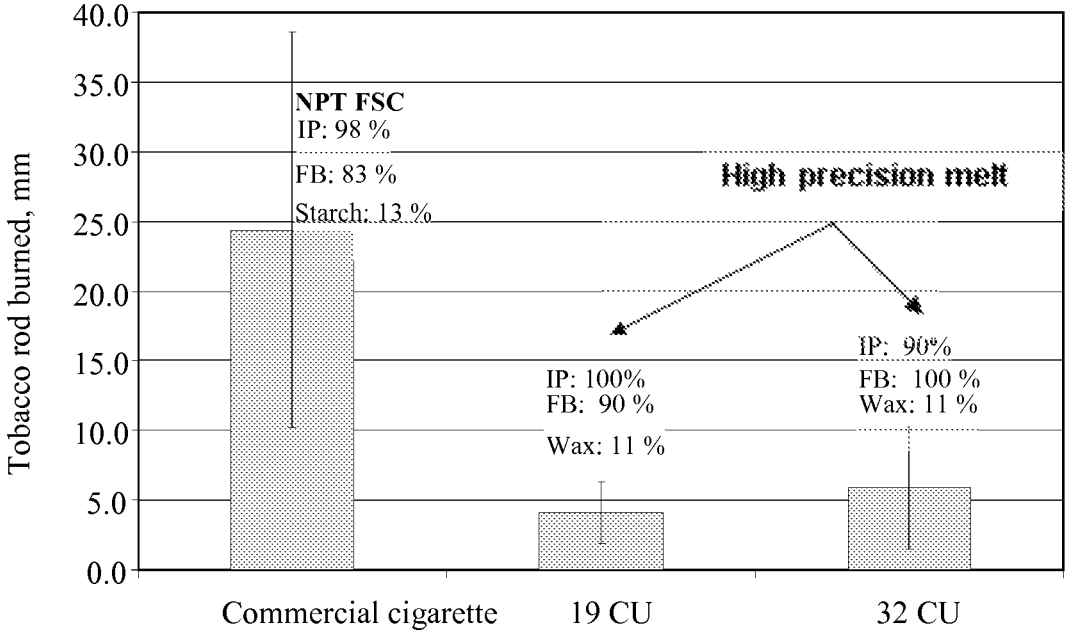
FIG. 5 is chart illustrating the length and standard deviation of measurements of tobacco rod consumed before the reference prior art fixed starch band cigarette and the reduced IP cigarettes of the present invention with 19 and 32 C.U. papers self-extinguished in the IP test.

Applicants have also found that the present invention results in a dramatically decreased time required for the cigarette to self-extinguish (reduced IP effect speed) compared to the prior art fixed starch-band reduced IP cigarettes. This reduced IP effect speed can be quantified by the length of the cigarette that is burned before it self-extinguishes. As shown in FIG. 5, for example, cigarettes having 19 C.U. and 32 C.U. wrappers treated with same PTMs applied with high precision wax jet printing method, according to the present invention self-extinguish after about 5 mm of the length of the cigarette has burned. It has been noted that the variability improved in this respect over the commercial, starch band technology. In contrast, about 25 mm length of the commercial LIP starch-band cigarettes burned before it self-extinguished. Cigarettes, embodying the present invention with wrappers having different porosities, demonstrate the similar improved LIP effect speed.

Applicants have further found that cigarettes embodying the present invention demonstrate much lower reduced IP effect speed variability. As shown by the standard deviations of the length of burn before self-extinguishing in FIG. 5, cigarettes embodying the present invention have a reduced IP effect speed variability of approximately 7 mm, as opposed to 30 mm for commercial reduced IP fixed starch-band cigarettes. In other words, cigarettes embodying the present invention have the additional benefit of self-extinguishing within a more uniform length of cigarette burn than the prior art LIP fixed starch-band cigarettes.

The current fixed starch-band commercial reduced IP cigarettes use lithography or flexography to print or deposit bands of starch-based or other solutions into papers, in the case of cigarettes, to reduce the air permeability in discrete paper regions and therefore to control their burn rate. Furthermore, this film-forming technique is implemented by costly off-line conversions of the base cigarette papers into low ignition propensity enabled papers by a third party manufacturing. In addition, the current starch-band approach produces reduced IP papers of large variability and poor robustness, ultimately adding to the cost of the paper. In contrast, the methodologies of the present invention are applicable to either off-line or optionally on-line production of reduced IP paper at the cigarette maker, e.g., printing and spraying techniques. Therefore, an additional benefit of the present invention is the reduction of these associated costs for reduced IP smoking articles.

Because the application of aqueous dispersions to cigarette wrapper can reduce the paper strength and pucker it in the coated areas, such cigarettes made have the tendency of being non-uniform and having an unappealing outer surface. Therein the applicants also developed the non-water based PTM formulations that can be deposited as droplets from hot melted state by the commercially available hot-melt sprayers and wax-inkjet printers. The non-limiting examples below include water solution as well as hot-melt system in their practices.

The applicants also discovered that in order to maximize the LIP property of cigarette paper, the PTM drop volume and the ability to place the drops such that they can fill efficiently the paper pores are important. These PTM characteristics depend on the PTM rheological properties, the surface tension of the PTM melt, and the drop volume specification of the deposition devices. Optimally, the drops should be placed near the to-be filled paper pores and they should have a drop volume comparable to the effective pore volumes, i.e. in 19 C.U. paper the efficient porous were measure to be in the range of 1-5 μm. These conditions would insure non- or minimum impact of deposited PTM droplets on the cigarette paper porosity prior to melting and an optimal air-blocking impact after melting. The applicants confirmed the above consideration by printing of two different formulations of PTMs on 19 C.U. paper having drop ejectors ejecting the drops of average sized of 10 pL and 50 pL, respectively. They found that the cigarettes made with wrapper with the smaller drops show LIP effect at lower concentrations of PTM, i.e., 5% versus 12% for 100% of LIP index.

Figure 6:
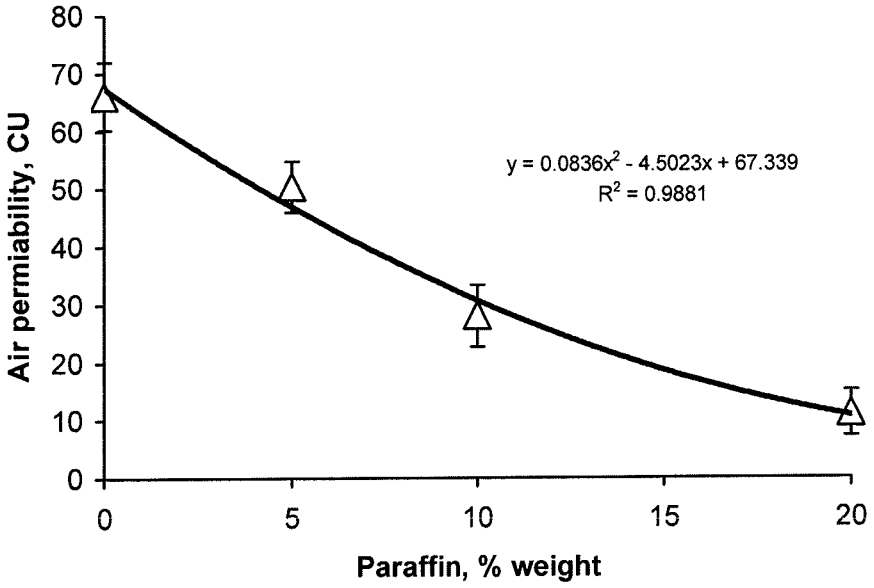
FIG. 6 shows the air permeability of a highly porous heat-treated PTM-modified papers.

The applicants also discovered that the air permeability of PTM-modified LIP paper does not change or decreases by more than 20% when the paper is exposed to the room temperature. Air permeability decreases much greater when it is been exposed to the heat of approaching firecone, as illustrated in FIG. 6. The degree of such decrease depends on the amount of PTM, pattern and precision of such deposition. The technique, usually used in industry for monitoring the air permeability in Coresta units, was modified by increasing the mechanical pressure on the paper-holding metal frame, which provided a better accuracy to the air permeability measurements. The applicants also used a more precise measuring technique for monitoring the permeability of paper and quality of PTM deposition on it, i.e., the porosimetry by using the mercury insertion. The results of those measurements have been used in the disclosure on this invention.

The following non-limiting examples are provided to illustrate different methods for application of PTM materials to semi-porous membranes and cigarette papers according to the present invention.

EXAMPLE 1

PTM Random Deposition

Figure 7:
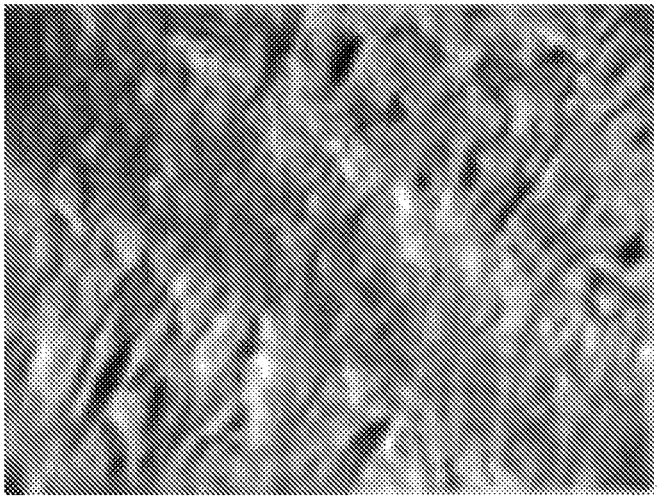
FIG. 7 shows microscopic images of 19 C.U. base cigarette, the same paper with printed random dots on it before and after exposing to 100° C.
Figure 7:
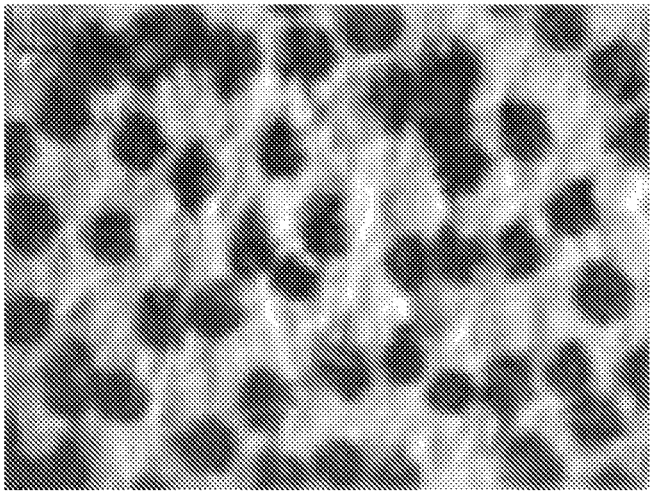
Figure 7:
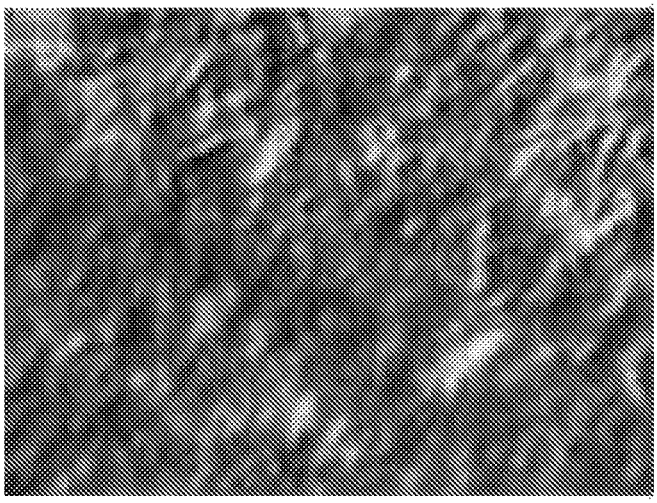

As demonstrated in this illustrative example, PTM patterns can be deposited randomly on the surface of semi-porous membranes in order to control gas permeability. It will be understood that the gas permeability of the semi-porous membrane drops as the amount of deposited PTM, or as its density increases. FIG. 7 illustrates the effect of random spot distribution deposited PTM for controlling the gas permeability of semi-porous cigarette base paper during the different temperature regimens subjected to the cigarette paper during smoking. The images of the micrographs shown in FIG. 7 are at 100× magnification. Image A is a micrograph of 19 C.U. cigarette base paper (i.e., not treated with PTM); Image B is a micrograph of the cigarette base paper of Image A treated with 40% density of a PTM random pattern applied with a printer; and Image C is a micrograph of the treated cigarette paper of Image B after annealing it at 190° C. for 5 min. As shown in Table A, the annealed PTM treated cigarette paper of Image C has lower gas permeability than the PTM treated cigarette paper of Image B, which, in turn, has lower gas permeability than the untreated cigarette base paper of Image A. This simulates the gas permeability of the PTM treated cigarette paper when subjected to the different temperature regimens for a cigarette during smoking.

TABLE A

| Paper sample | Air permeability, C.U. | Weight percent PTM on paper |
|---|---|---|
| Base Paper | 19-24 | 0 |
| PTM Treated Base Paper | 16-20 | 5-25 |
| PTM Treated Annealed Paper | 0-5 | 5-25 |

Typical air permeability of base cigarette paper, PTM treated paper over the content ranges shown, and subsequent thermal treatment of the PTM treated papers.

EXAMPLE 2

PTM Deposited as Patterns

Figure 8:
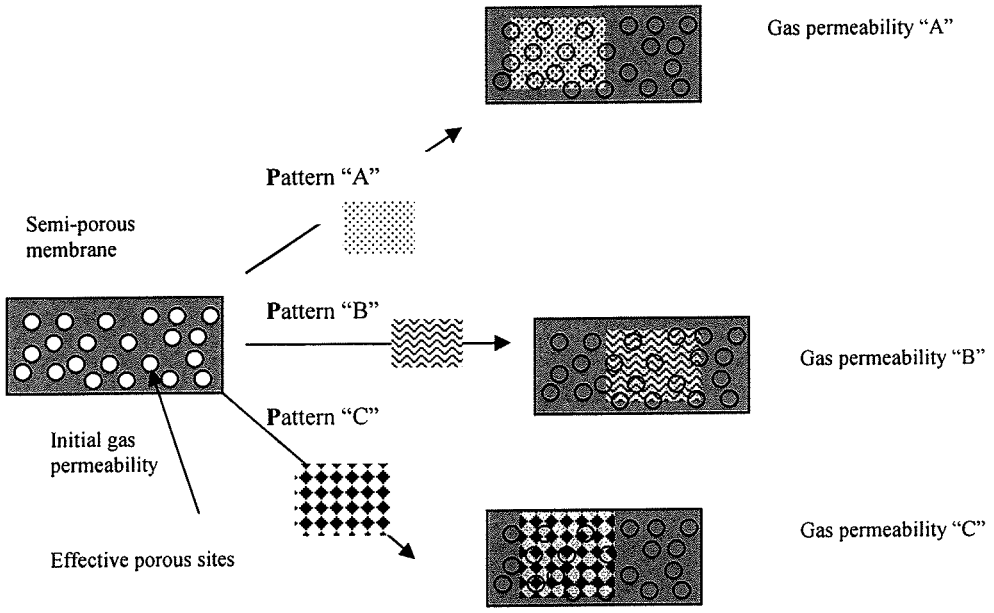
FIG. 8 is a diagram of illustrative PTM distributions made by printing different patterns on cigarette paper in respect to the air paths in the original or base paper.

In this illustrative example, PTM has been deposited on membranes in a manner to form surface patterns and/or shapes to change the gas permeability of semi-porous membranes. Such patterns can be unique or repeatable, or consist of a combination of different patterns. Exemplary patterns are shown in FIG. 8. Such patterns can be created of well-defined shapes and forms such as alphanumeric characters, geometric shapes as well as lines of various forms and thickness. The PTM quantity to achieve the desired effect is related to the patterns. In addition, the air permeability of cigarette paper may be modified by printing various PTM patterns while keeping constant the PTM mass deposited on the paper. Further change in air permeability can be obtained by heat-treating of the semi-porous membrane at a temperature higher than the phase transition temperature of the PTM.

Figure 9:
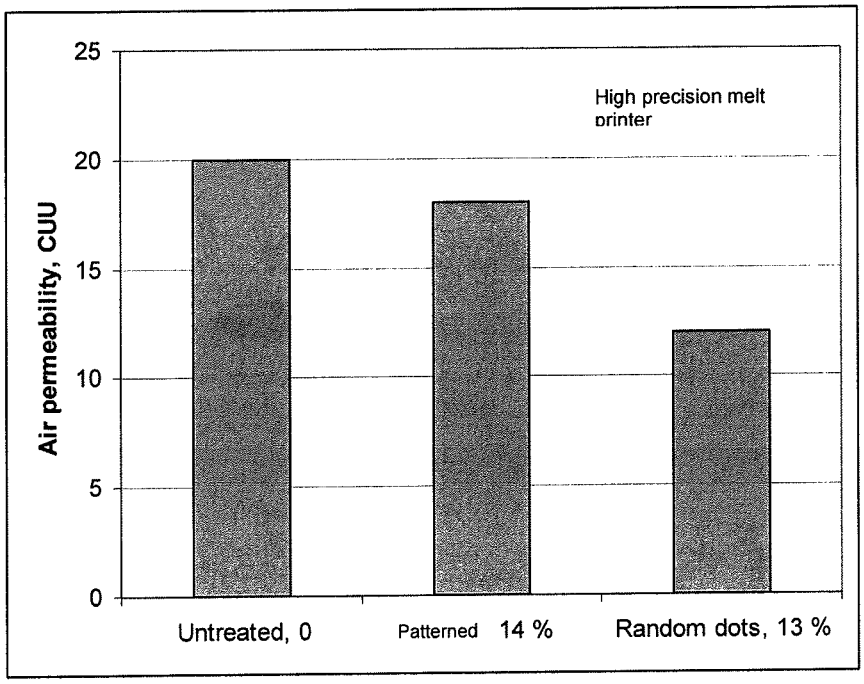
FIG. 9 is a chart showing the permeability of the base and printed cigarette papers as a function of the applied patterns illustrated in FIG. 8.

The bar graph in FIG. 9 illustrates this strategy with air permeability measurements for samples of paper that were either deposited with patterned PTMs or "random dots." After discounting the small reduction of air permeability after treating the paper, under similar amount of deposited PTM-on-paper for 19 C.U. cigarettes, patterned application of the PTM increases the air permeability by 72% versus randomly distributed dot pattern application of the PTM.

EXAMPLE 3

PTM Deposited as Fractals

Figure 10:
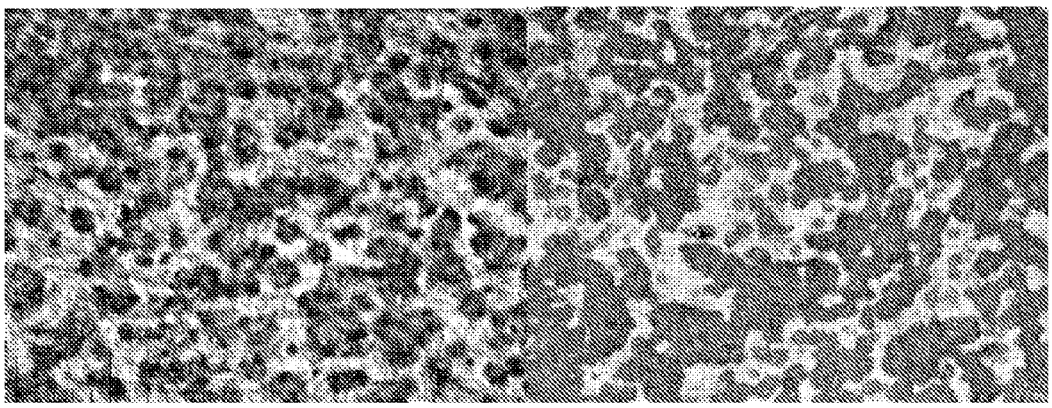
FIG. 10 is microscopic images the 19 C.U. paper PTM fractal patterns.

The air or gas permeability of a semi-porous membrane can also be changed by depositing PTM fractal patterns on the surface of the semi-porous membrane or cigarette paper. The term "fractal patterns" as used herein refers to geometric patterns of varying fractal dimensions or built as reticulated structures. The fractal dimension can be related to the average pore size and pore size distribution. Fractals such those shown in FIG. 10, are therefore useful for this invention.

EXAMPLE 4

PTM Cluster Deposition

The gas permeability of semi-porous membranes also can be changed by depositing PTM as individual or pluralities of PTM clusters of particles on the surface of membrane. By changing the distribution and density of the PTM clusters, the gas or air permeability of the semi-porous membrane may be modified.

Figure 11:
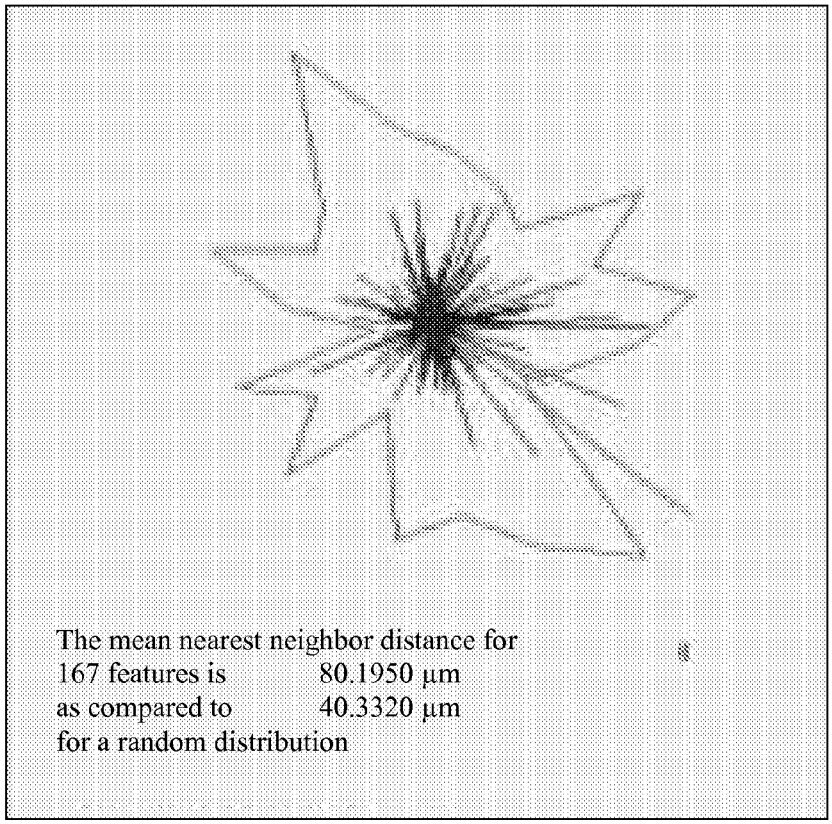
FIG. 11 is a mean nearest neighbor distance between deposited PTM on semi-porous surface.

A method to examine clusters is by considering the mean nearest neighbor distance between the cluster particles of micrograph images of deposited PTM on semi-porous membrane. This distance is then compared to the one found under random deposition. Large variance between the two indicates the particulate clustering magnitude. An example of PTM cluster is shown in FIG. 11, where the mean nearest neighbor distance for 167 PTM spot features is 80 μm versus 40 μm for a random distribution of the same features on the same image area.

EXAMPLE 5

PTM Site Specific Deposition

Figure 12:
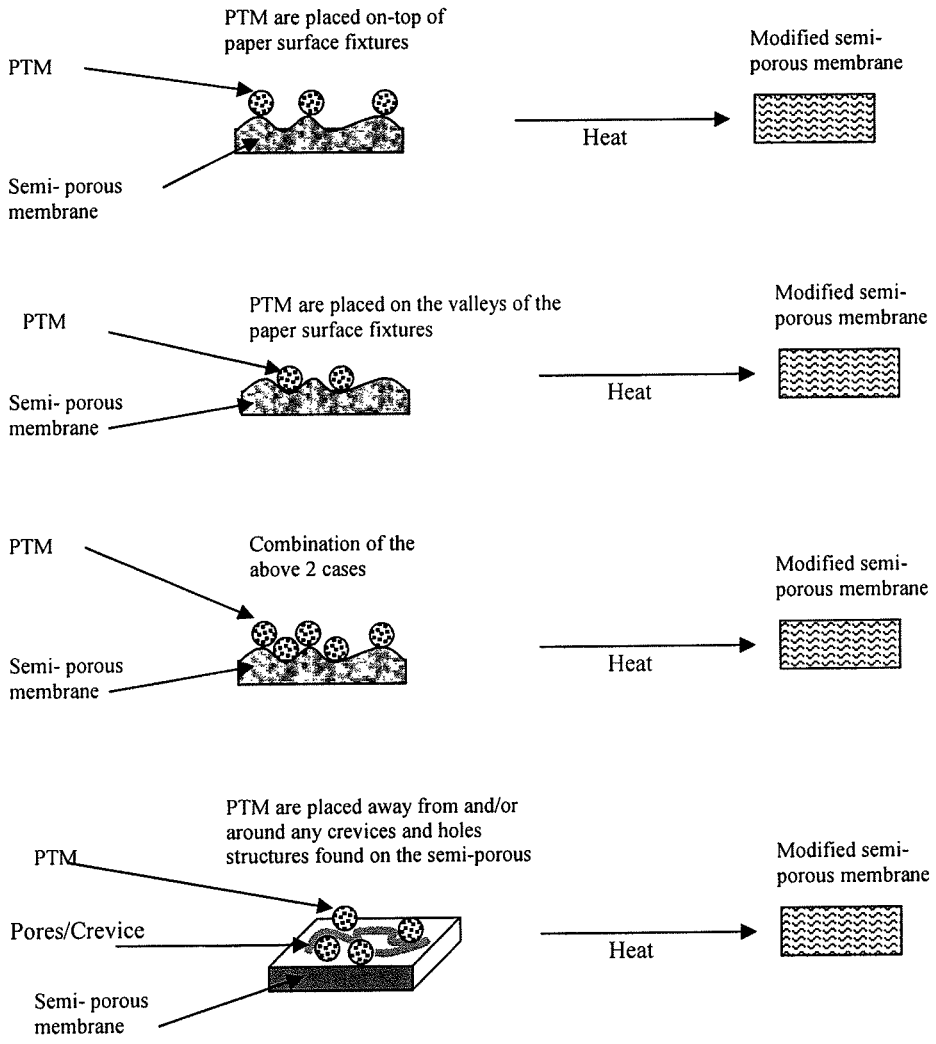
FIG. 12 is a diagram of the PTM distribution and migration on surface of semi-porous membrane.

Another method used according to the present invention to control/change the gas or air permeability of semi-porous membranes is a PTM site specific deposition; this approach takes advantage of fixtures and structures already present on the surface. The deposited patterns can be placed right off-top, on-top, around the pores or on-off combinations of low air/gas gas permeability areas of the membrane. In the first case, the gas permeability is immediately reduced after deposition of PTM particles on the surface and then further reduced upon heating and triggering the PTM phase transition. In the second case, the gas permeability decreases only upon heating. In the third case, there is an immediate reduction in gas on gas permeability that increases upon heating the membrane. Structures such as fibers, surface defects as well of low/high paper density, holes and other fixtures comprise numerous examples when a site specific deposition is applicable. Four illustrative examples are illustrated in FIG. 12.

EXAMPLE 6

PTM Gradients and Zone Specific Deposition

Figure 13:
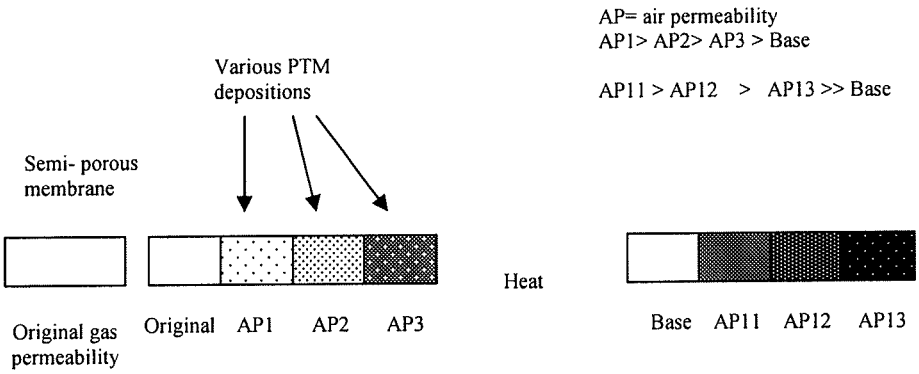
FIG. 13 is a diagram of gradient and non-gradient multiple zone PTM deposition.

In another approach, the PTM may be deposited on specific and unique regions (such as individual or pluralities of zones or bands) of the membrane surface while leaving some areas untreated. This approach may create air permeability/porosity gradients as well as randomly distributed zones of various air permeability/porosity. FIG. 13 illustrates a gradient and non-gradient multiple zone PTM deposition application. As with all other deposition of the methods described herein, the deposited patterns can be created either with PTM, non-PTM materials or combinations of thereof.

Figure 14:
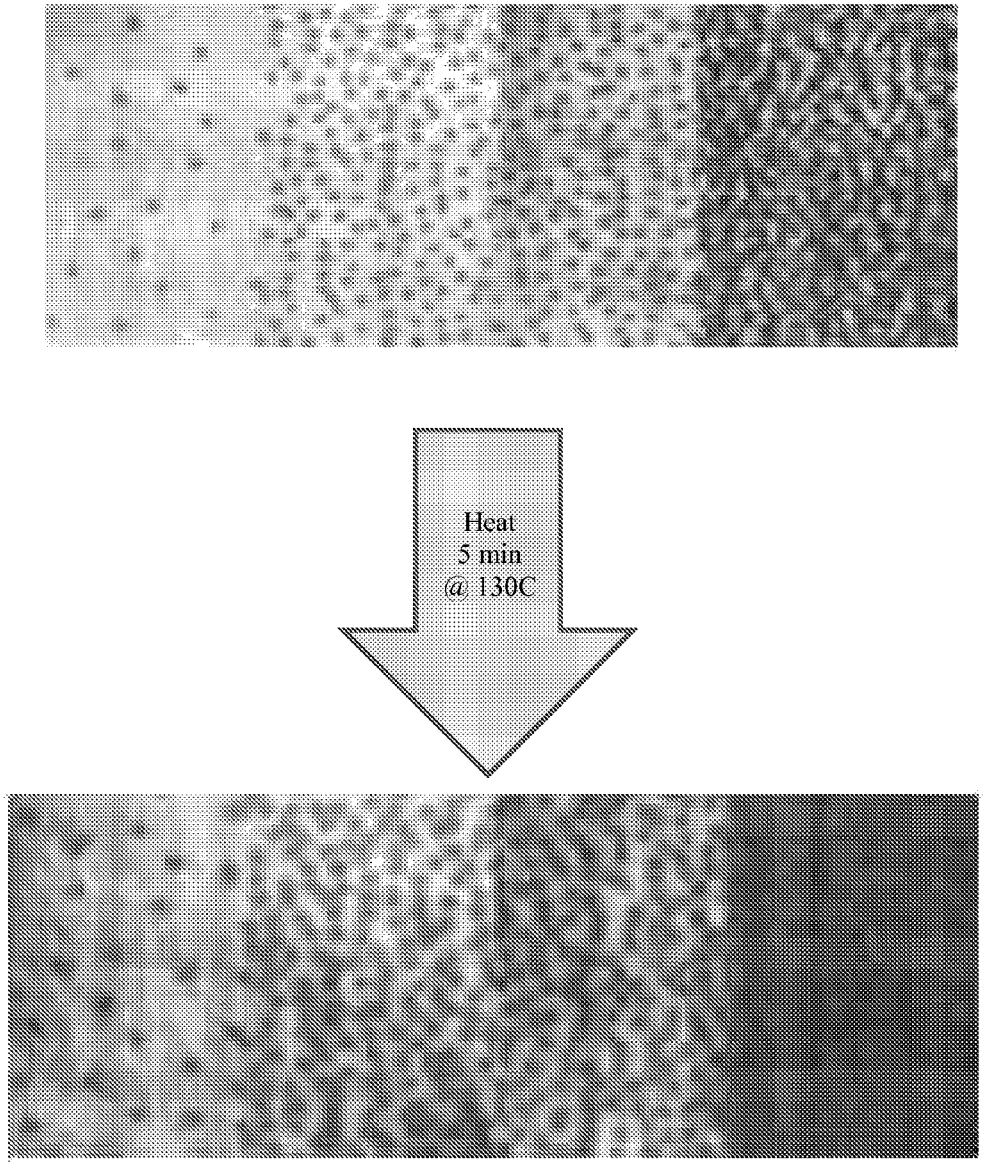
FIG. 14 shows microscopic images of the PTM, distributed on semi-porous membranes, and their melting at 130° C.

This approach is demonstrated in the micrographs below taken at 25× magnification in FIG. 14. The left side of the image belongs to a 19 C.U. paper after depositing randomly PTM's with 20, 40, 60 and 80% print density sequences. The right side of the image shows this paper after heat treatment at 130 C for 5 min. These micrographs shows that the flow of the melted PTM covers in various degree the surface pores of the semi-porous membrane and therefore reduces the air permeability from the left to right of the shown micrograph segments.

Figure 15:
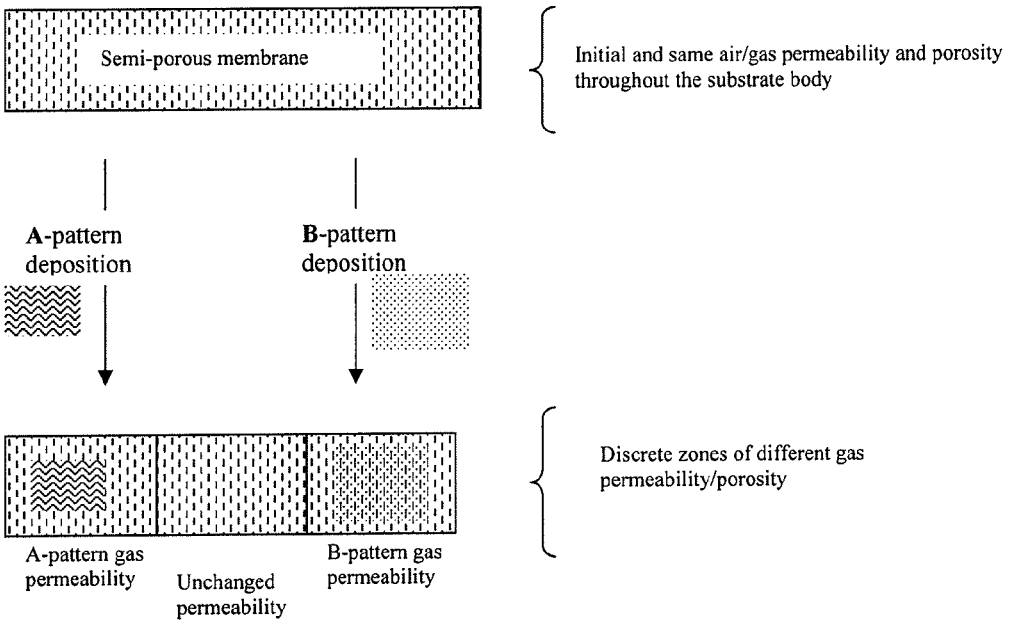
FIG. 15 is a diagram of various patterns of PTM applied to a semi-porous membrane.

The arrangement or configuration of the PTM is not limited to sequential deposition as described above, but can also include other PTM deposition sequential orders and distribution configurations. Examples of alternative deposition configurations are shown in FIG. 15.

EXAMPLE 7

Three-Dimensional Deposition

Figure 16:
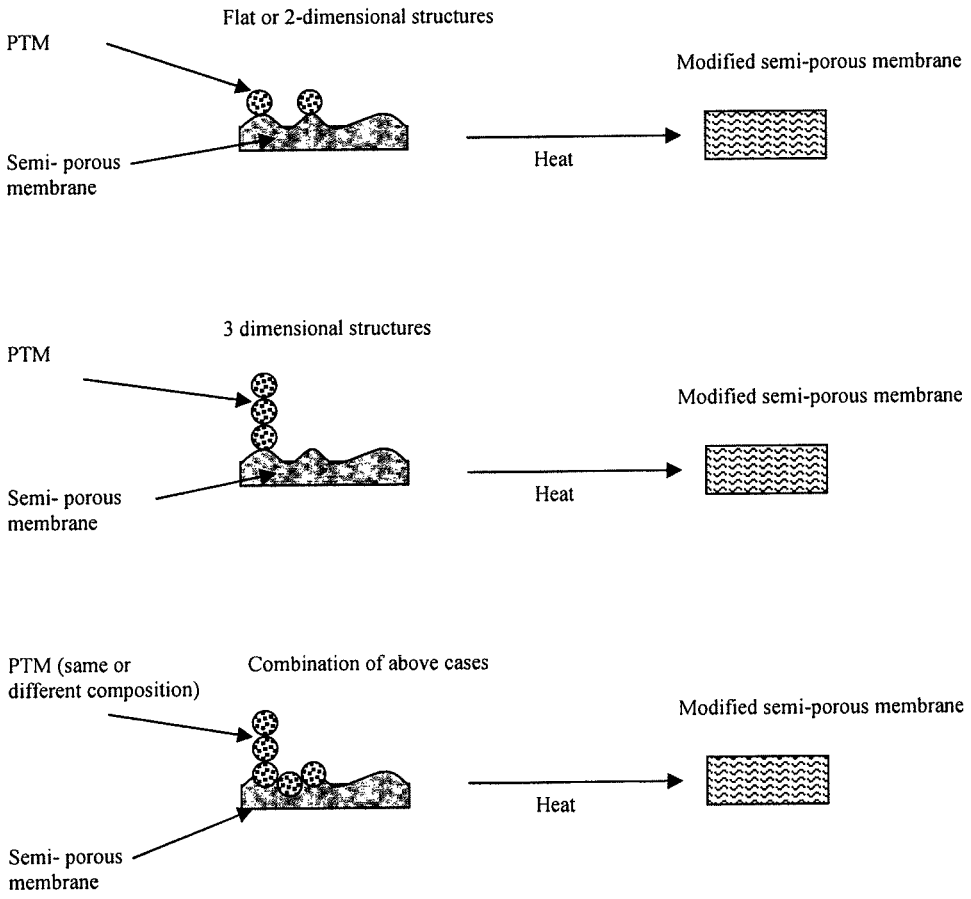
FIG. 16 is a diagram of a three dimensional distribution of PTM and their heat-induced migration on the surface of semi-porous membrane.

Another method according to the present invention for changing the air/gas permeability of semi-porous membranes is a deposition of PTM wherein the deposited drops form 3D structures on the surface of the membrane. Such structures can be created by depositing PTM drops on top of previously deposited drops, as illustrated schematically in FIG. 16. The drop compositions can be similar or different within the surface of single membrane. These compositions facilitate formation of physical structures, which can be defined as a homogeneous and heterogeneous, and these features influence the PTM rheology. Using this method one can influence on-line the gas permeability of a semi-porous membrane without having to restart a manufacturing process with a different porosity stock item because of different product specification set.

Figure 17:
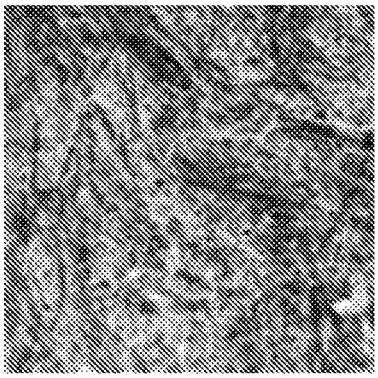
FIG. 17 shows microscopy images of the base 19 C.U. paper and PTM printed and heat-treated on the surface of semi-porous membrane.
Figure 17:
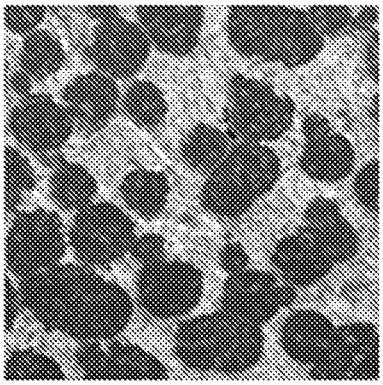
Figure 17:
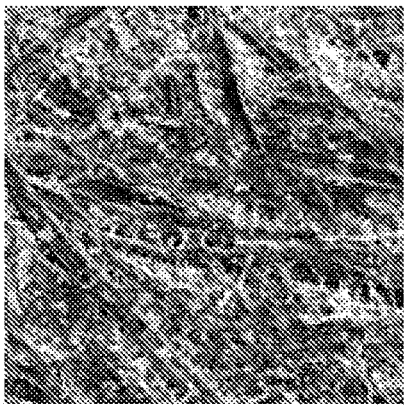

As shown in electron micrographs depicted in FIG. 17, this three dimensional disposition method may result in numerous surface features such as holes, peaks, valleys found on semi-porous membranes (i.e., cigarette paper, etc.). The first micrograph shows an untreated 19 C.U. cigarette paper prior to depositing any PTM's on its surface. The second and the third micrographs show randomly spot PTM printed images for before and after heat treatment, respectively. They show clearly surface fixtures prior to heat treatment. After that, they are not observed because they have migrated into the paper sub-surface.

Figure 18:
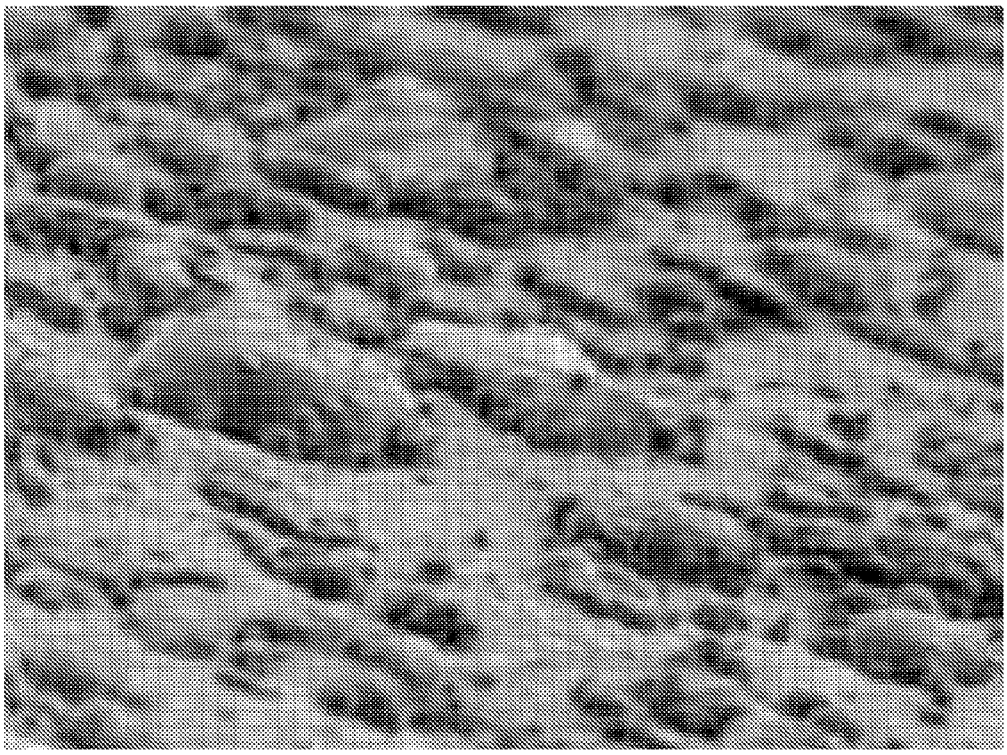
FIG. 18 is a microgram (SEM, 80°, ×500) of PTM-sprayed paper.

This 3-dimensional deposition method can also be achieved by using hot-melt technology for the PTM deposition. A micrograph of an exemplary cigarette wrapper treated using a hot-melt 3-dimensional PTM deposition method is shown in FIG. 18. The accumulated PTM on these structures can be use as material available to reduce the semi-membrane porosity/air permeability after heat treatment.

EXAMPLE 8

PTM from Aqueous Suspensions, Sprayed on Paper

The aqueous suspensions of individual waxes and their mixtures are prepared using the fine powders of waxes, exemplified in Table 1, and suspended in water in the presence of 1% Tween 80 surfactant. The types of specific waxes differ primarily by the melting temperatures and determine both LIP index of built cigarette, and its appearance when smoked. The preferable formulations contain carnauba, polyethylene, polypropylene and ethylene-stearamide. The high-melted waxes are added mostly for the purpose of better appearance. Such aqueous suspensions are sprayed on paper at room temperature in the predetermined quantities, followed by quick drying by infra-red or convection heat source. The process of paper modification is done on-line on a cigarette making machine or off-line if only cigarette paper is been produced.

TABLE B

| Wax material and manufacturer | Basic content | $T_m$, ° C. | % of solid formulation |
|---|---|---|---|
| Lubrizol Advanced Materials, Cleveland, OH | | | |
| Liquilube 437 wax emulsion | P | 47-107 | 0-10 |
| Liquilube 414 polypropylene | PP | 38-48 | 5-30 |
| Pinnacle 1555 polyethylene | PE | 64-121 | 5-50 |
| Pinnacle 1955 carnauba | C | 82-85 | 5-90 |
| ChemCor, Chaster, NY | | | |
| Paraffin emulsion 10135 | P | 25-95 | 0-10 |
| Carnauba emulsion 3N30 | C | 46-83 | 5-90 |
| Poly emulsion 10G38SP | PE, P | 100 | 5-50 |
| RM-25-56 polyethylene | PE | 106 | 5-50 |
| Shamrock, Newark, NJ | | | |
| Hydrocer EP91, DP69 | P | 40-80 | 0-10 |
| Hydrocer EC35, EC98, 132 | C | 77-112 | 5-90 |
| S-Nauba-5021 Carnauba alloy | C | 84 | 5-90 |
| Koster Keunen, Watertown, CN | | | |
| NF Emulsifying wax, Wax 109P | PE | 52 | 5-50 |
| Carnauba EC-80, Wax 193P | C | 83 | 5-90 |
| PEG-8 Beeswax, Wax 202P | B | 70 | 0-80 |
| Micro Powders, Tarrytown, NY | | | |
| Superslip 6515, 6650, Aquabed 916 | PP + PE | 67-143 | 0-100 |
| Propyltex 325S, polypropylene | PP | 161 | 0-100 |
| MP-28C, synthetic wax | synthetic wax | 67-116 | 0-100 |
| Microclear 116, polymers | PE + C | 83-124 | 0-100 |
| MPP-645XF, polyethylene | PP + PE | 127 | 0-100 |
| Frank B. Ross Co., Rahway, NJ | | | |
| Ross Wax 140, 160 | E | 70-168 | 0-30 |

Waxes used for aqueous wax formulations. Components: polyethylene (PE), polypropylene (PP), carnauba (C), paraffin (P), Beeswax (B), ethylenestearamide (E), petroleum residue (PR). Typically, a 25-50% wax is suspended in water for spraying on paper.

EXAMPLE 9

PTM from a Non-Aqueous Melted State, Sprayed or Printed on Paper

Table C shows the examples of the developed formulations for the case of hot-melted PTMs. These formulations were prepared by co-melting the PTM ingredients in the form of solid, non-aqueous powders and a surfactant. Likewise to the previous Example, the preferable formulations contain carnauba, polyethylene, and polypropylene. Such non-aqueous wax formulations are sprayed or printed on paper at the temperature 10-50° C. higher than that of the melting points of the highest melted components in the pre-determined quantities. The treated paper was not required to be dried, since the process does not involve solvents, such as water. The process of paper modification is done on-line on a cigarette making machine or off-line if only cigarette paper is been produced.

TABLE C

Waxes used for non-aqueous wax formulations, and their main parameters.

| Transient Band useful property | Ingredient | Concentration, % Range used | Range preferred |
|---|---|---|---|
| Width controller high T | polypropylene | 0-100 | 10-25 |
| Vehicle, adhesive | carnauba | 0-100 | 40-50 |
| Diffusion control | polyethylene | 0-70 | 5-60 |
| High melt, surfactant | EBS | 0-45 | 30-40 |
| Low melt, flavourant | menthol | 0-40 | 5-35 |
| Surfactant | Tween 80 | 0.5-2 | 1-1.5 |

EXAMPLE 10

PTM within the Paper Structure

Figure 19:
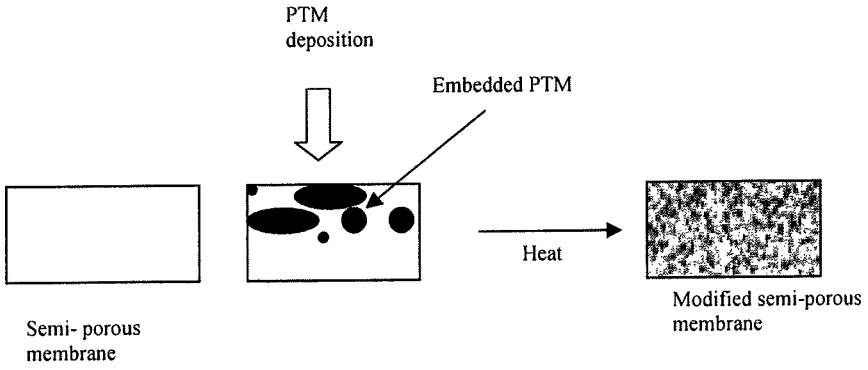
FIG. 19 is a diagram of the distribution and density of paper embedded PTM's to affect the gas permeability of the semi-porous membranes prior and after heat treatment.

The gas permeability of the semi-porous membranes can also be changed by incorporating PTM's within the structure of the semi-porous membrane. By changing the distribution and density of these embedded PTM, the gas permeability of the semi-porous membrane prior to and after heat treatment may be modified as schematically shown in FIG. 19.

Figure 20:
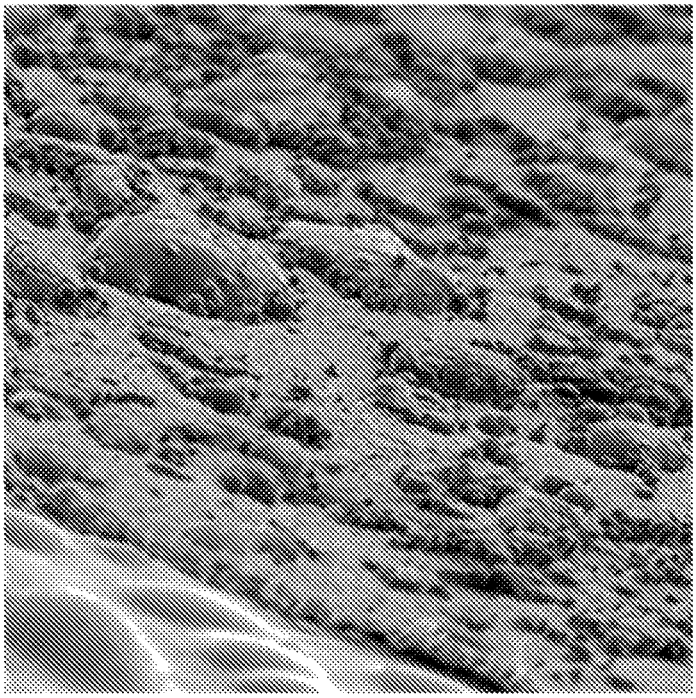
FIG. 20 is micrographs of the morphology of PTM on cigarette paper at 500× magnification.
Figure 20:
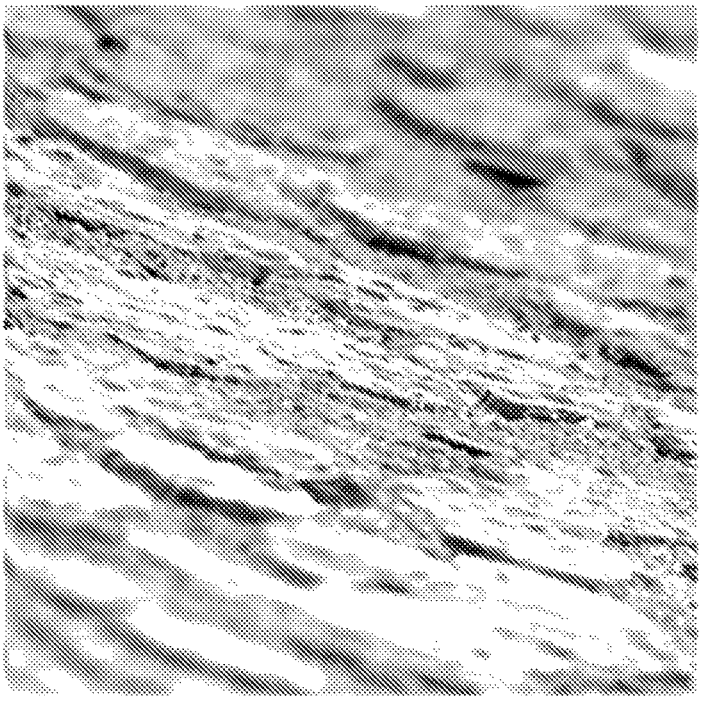

In addition to the benefits already described by the used of PTM to control air permeability of wrapping paper, the applicants discovered an additional improvement when the deposited PTMs are subjected to the pressure under the temperature sufficiently high to induce PTM penetration through the surface layer of the semi-porous membrane. FIG. 20 is a scanning electron microscopy (SEM) micrograph, taken at 500× magnification, of PTM samples before and after "heat and press," or fusing. It shows clearly that the "heat and press" post-processing of deposited PTM has flattened the PTM drops and probably likely merged them into a semi-porous matrix.

Figure 21:
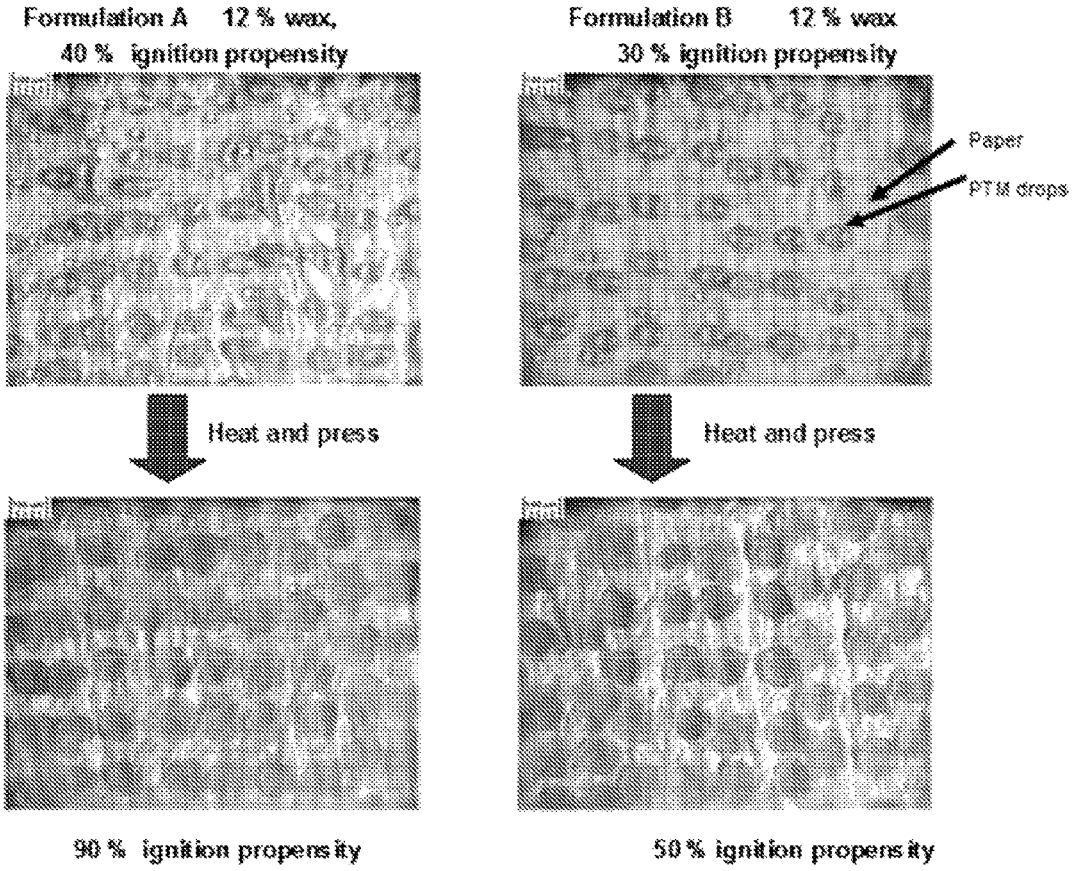
FIG. 21 shows the "Heat and press" morphology and ignition propensity impact.

This inventive "heat and press" treatment allowed the applicants to further increase the LIP property of smoking articles. FIG. 21 shows the effect of the "heat and press" on ignition propensity for PTM deposited using a wax printer, Markem 5800, on cigarette paper. For these two different hot-melt systems under the same loading of PTM on paper, the "heat and press" treatment reduced the ignition propensity from 40 to 90% and 30 to 50%, respectively.

Figure 22:
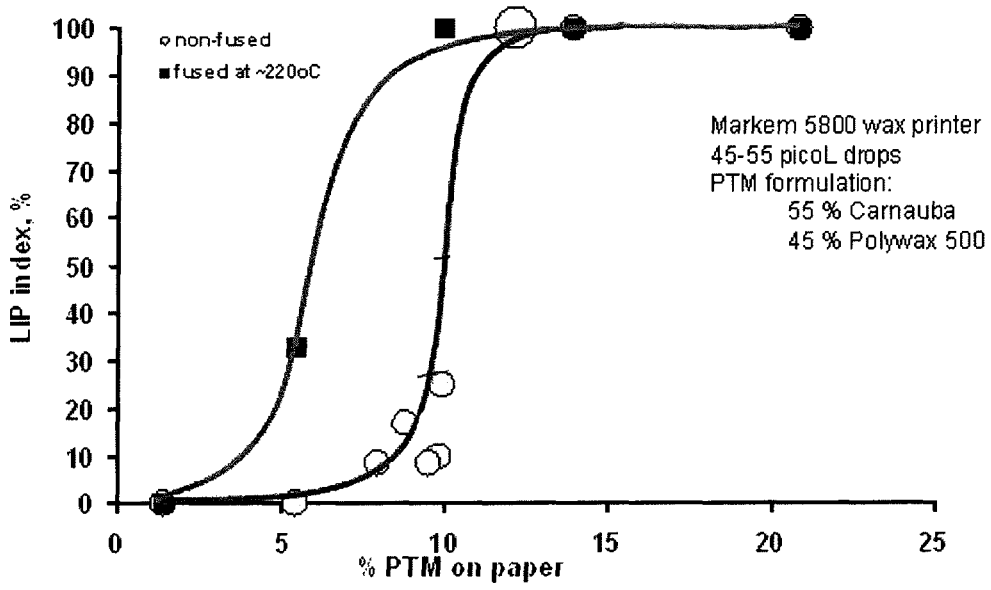
FIG. 22 shows the effect of "heat and press" on LIP index.

Furthermore, the use of the "heat and press" also assists implementation of the technology because it reduces the amount of PTM needed to obtain the LIP benefit. This proved to be important to avoid a negative impact on narcoleptic properties that might occur if a high loading of PTM is used on paper; the excessive PTMs would contribute to the content of smoke stream with the potential to affect the taste. FIG. 22 shows this beneficial effect of the "heat and press". Represented in this figure is the formulation of 55% carnauba and 45% polyethylene (Polywax 500) formulation, printed on the 19 C.U. cigarette paper. The figure reveals the difference in LIP characteristics in the cases of non-fused and the fused conditions and shows that the "heat and press" process shifts the on-set of the LIP index towards lower PTM concentration on paper.

Figure 23:
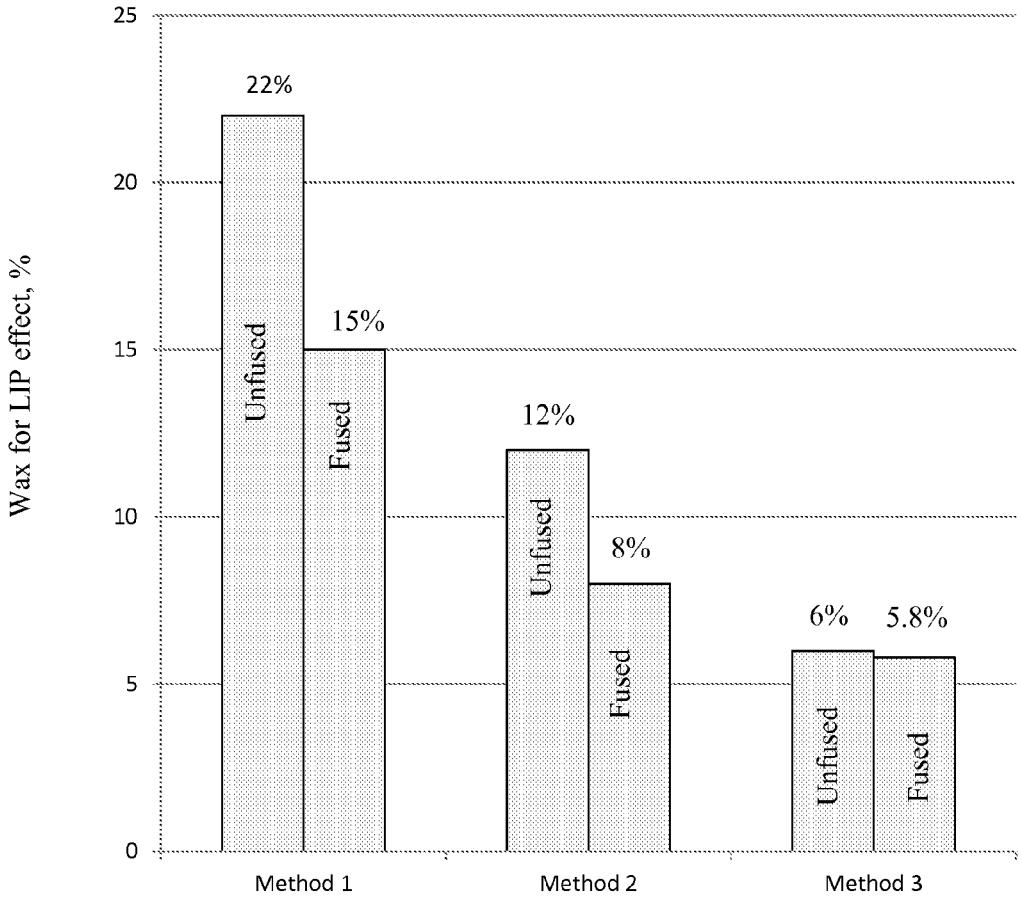
FIG. 23 shows the impact of PTM deposition precision on LIP property.

The applicants also discovered that the precise placement of PTM on cigarette paper is also beneficial in terms of reduction of the amounts of PTM necessary to be added to reach the on-set of reduced IP property and the high LIP index. FIG. 23 shows three different deposition methods and their effect on the LIP index at various PTM loading. Method 1 uses a hot-melt sprayer to provide a random pattern of wax drops (size estimated at 1-200 microns) on wrapper paper. Method 2 uses a high speed wax jet printer to provide an ordered pattern of wax drops (size estimated at 100-200 microns) on wrapper paper. Method 3 uses a high precision wax jet printer with thermal fusing to provide dithered patterns of wax drops (size estimated at 20-25 microns) on wrapper paper. Based on the interpretation of the result shown in FIGS. 21, 22 and 23, the applicants believe that there is a synergistic effect between the template and precision of the drop placement and the chemical nature of the used PTM formulation on the resulting LIP property. FIG. 23 shows that a combination of the "heat and press," or fusing treatment and the precise drop placement reduces the required PTM amount on paper, therefore promoting the LIP effect.

The disclosed PTM application methods of the present invention appear to be versatile and adaptable; therefore they can be integrated into the cigarette makers to manufacture cigarettes at commercial speed. In addition, the disclosed PTM application methods are also adaptable to a broad range of paper contents and structures to deliver the desired LIP performance. Since the current state of the art relies on the aqueous base inks, the method provides benefit from using the non-aqueous printing compositions. This method may allow a quick implementation of PTM-based reduced IP to meet numerous product requirements. As an example, the disclosed methods may be particularly useful to overcome the issues associated with the roll-to-roll variability starch-band reduced IP technology.

It will also be understood that the application methods of the present invention may be suitable for the on-line automation within a feedback loop for the air permeability changes as required by the smoking articles product specifications. Because these methods can be easily implemented with hot-melt printers, inkjet printers, and other spray deposition equipment, they also make possible to fabricate on-line reduced IP featured cigarettes. Enhanced reduced IP performance reduces costs with respect to the current fixed-band printing technology. It allows precise placement of PTM on smoking articles with respect of the tobacco column to improve cigarette quality as well as to eliminate the base paper conversion cost. It also allows a faster reduced IP effect speed than the current reduced IP technology because of the reduced IP technology is applied fully throughout the burning smoking article length.

What is claimed is:

1. A method of applying a phase transition material to impart reduced ignition propensity to a smoking article, the smoking article comprising a tobacco column and a wrapper surrounding the tobacco column, wherein the wrapper comprises a porous structure with a base permeability, the method comprising forming a pattern of the phase transition material on a surface of the wrapper such that, i) in the absence of heat of a burning firecone, the base permeability of the wrapper is not reduced by more than 20% as a result of the phase transition material, and ii) when the phase transition material is subjected to heat of the burning firecone of the tobacco column, the phase transition material at least partially fills the wrapper porous structure in proximity to the burning firecone to form a non-fixed band on the wrapper having a reduced permeability that is lower than the base permeability; and surrounding the tobacco column with the wrapper; wherein the reduced permeability is selected to permit sufficient air flow through the wrapper to sustain free burn; and further wherein the reduced permeability is also selected to impart reduced ignition propensity when the smoking article is placed on a substrate, such that there is insufficient air flow through the wrapper to sustain combustion of the burning firecone or to sustain an intensity of the burning firecone necessary to ignite the substrate; and further wherein the phase transition material is selected from the group consisting of paraffin, tobacco wax, Solanesol, carnauba, Beeswax, microcrystalline wax or combinations thereof.

2. The method according to claim 1, wherein forming a pattern of the phase transition material on the surface of the wrapper comprises forming a repeatable pattern to essentially the entire surface of the wrapper.

3. The method according to claim 1, wherein forming a pattern of the phase transition material on the surface of the wrapper comprises depositing the phase transition material as a cluster of particles on the surface of the wrapper.

4. The method according to claim 1, wherein forming a pattern of the phase transition material on the surface of the wrapper comprises depositing the phase transition material as a plurality of clusters of particles on the surface of the wrapper.

5. The method according to claim 1, wherein forming a pattern of the phase transition material on the surface of the wrapper comprises forming a pattern on discrete regions of the surface of the wrapper.

6. The method according to claim 1, wherein forming a pattern of the phase transition material on the surface of the wrapper comprises forming a pattern having a gradient of concentration of the phase transition material on the surface of the wrapper.

7. The method according to claim 6, wherein the gradient pattern of the phase transition material, when subjected to the heat of the burning firecone of the tobacco column, forms an area on the wrapper having a variable reduced permeability that is lower than the base permeability.

8. The method according to claim 1, wherein forming a pattern of the phase transition material on the surface of the wrapper comprises depositing a three-dimensional layer of the phase transition material on the surface of the wrapper.

9. The method according to claim 1, wherein forming a pattern of the phase transition material on the wrapper comprises depositing the phase transition material on the surface of the wrapper and applying sufficient pressure to the phase transition material to induce penetration into the surface of the wrapper.

10. A method of applying a phase transition material to impart reduced ignition propensity to a smoking article, the smoking article comprising a tobacco column and a wrapper surrounding the tobacco column, wherein the wrapper comprises a porous structure with a base permeability, the method comprising forming a pattern of the phase transition material on a surface of the wrapper such that, i) in the absence of heat of a burning firecone, the base permeability of the wrapper is not reduced by more than 20% as a result of the phase transition material, and ii) when the phase transition material is subjected to heat of the burning firecone of the tobacco column, the phase transition material at least partially fills the wrapper porous structure in proximity to the burning firecone to form a non-fixed band on the wrapper having a reduced permeability that is lower than the base permeability; and surrounding the tobacco column with the wrapper; wherein the reduced permeability is selected to permit sufficient air flow through the wrapper to sustain free burn; and further wherein the reduced permeability is also selected to impart reduced ignition propensity when the smoking article is placed on a substrate, such that there is insufficient air flow through the wrapper to sustain combustion of the burning firecone or to sustain an intensity of the burning firecone necessary to ignite the substrate; and further wherein forming a pattern of the phase transition material on the surface of the wrapper comprises forming a fractal pattern.

11. The method of claim 10, wherein the fractal pattern has varying fractal dimensions.

12. The method of claim 10, wherein forming a pattern of the phase transition material on the surface of the wrapper further comprises forming a repeatable pattern to essentially the entire surface of the wrapper.

13. The method of claim 10, wherein forming a pattern of the phase transition material on the surface of the wrapper further comprises depositing the phase transition material as a cluster of particles on the surface of the wrapper.

14. The method of claim 10, wherein forming a pattern of the phase transition material on the surface of the wrapper further comprises depositing the phase transition material as a plurality of clusters of particles on the surface of the wrapper.

15. The method of claim 10, wherein forming a pattern of the phase transition material on the surface of the wrapper further comprises forming a pattern on discrete regions of the surface of the wrapper.

16. The method of claim 10, wherein forming a pattern of the phase transition material on the surface of the wrapper further comprises forming a pattern having a gradient of concentration of the phase transition material on the surface of the wrapper.

17. The method of claim 16, wherein the gradient pattern of the phase transition material, when subjected to the heat of the burning firecone of the tobacco column, forms an area on the wrapper having a variable reduced permeability that is lower than the base permeability.

18. The method of claim 10, wherein forming a pattern of the phase transition material on the surface of the wrapper further comprises depositing a three-dimensional layer of the phase transition material on the surface of the wrapper.

19. The method of claim 10, wherein forming a pattern of the phase transition material on the wrapper further comprises depositing the phase transition material on the surface of the wrapper and applying sufficient pressure to the phase transition material to induce penetration into the surface of the wrapper.

20. The method of claim 10, wherein the phase transition material is selected from the group consisting of polyethylene, polypropylene, ethylene-stearamide, or combinations thereof.

* * * * *